US006342838B1

(12) United States Patent
Kolton et al.

(10) Patent No.: US 6,342,838 B1
(45) Date of Patent: Jan. 29, 2002

(54) ELECTRONIC ARTICLE SURVEILLANCE MARKER AND CONTAINER THEREWITH

(75) Inventors: Chester Kolton, Westfield; Michael Norman, East Brunswick, both of NJ (US)

(73) Assignee: B&G Plastics, Inc., Newark, NJ (US)

( * ) Notice: Subject to any disclaimer, the term of this patent is extended or adjusted under 35 U.S.C. 154(b) by 0 days.

(21) Appl. No.: 09/650,064

(22) Filed: Aug. 29, 2000

(51) Int. Cl.[7] ..... G08B 13/14
(52) U.S. Cl. ..... 340/572.1; 340/572.8
(58) Field of Search ..... 340/572.1, 572.8, 340/572.9; 24/455; 40/310, 651, 658, 660, 668, 669

(56) References Cited

U.S. PATENT DOCUMENTS 4,804,943 A * 2/1989 Soleimani ..... 340/572
6,137,413 A * 10/2000 Ryan, Jr. ..... 340/572.8
6,191,691 B1 * 2/2001 Serrault ..... 340/572.8

* cited by examiner

*Primary Examiner*—John A. Tweel
(74) *Attorney, Agent, or Firm*—Robin, Blecker & Daley

(57) ABSTRACT

An EAS marker assembly comprises a housing defining an interior cavity and an EAS marker disposed in the housing interior cavity, the housing having an exterior flexible member cantilever-supported by the housing. A container has an inlet/outlet port and an EAS marker assembly is configured to be passable through the inlet/outlet port into an interior of the container and thereupon to expand to a dimension exceeding a dimension of the container inlet/outlet port.

23 Claims, 5 Drawing Sheets

ELECTRONIC ARTICLE SURVEILLANCE MARKER AND CONTAINER THEREWITH

FIELD OF THE INVENTION

This invention relates generally to electronic article surveillance (EAS) markers and pertains more particularly to EAS markers for containers.

BACKGROUND OF THE INVENTION

A well-known practice in article security is the use of so-called anti-theft tags which incorporate electronic article surveillance (EAS) markers. Such tags are secured to articles and are removed or rendered inactive at checkout. Where fraudulent avoidance of checkout (shop-lifting) occurs, the markers are sensed by EAS systems, e.g., at store exits, and a suitable alarm is generated.

One form of EAS marker in widespread use is in the form of a flat, thin, flexible, rectangular, adhesive-backed member which is applied adhesively to flat or curved surfaces of articles.

The above-discussed adhesive-backed EAS marker can be removed by an unscrupulous customer with ease, thereby rendering the article without EAS protection and removable from a facility without being paid for.

SUMMARY OF THE INVENTION

The subject invention has as its primary object a solution to the above problem as the problem applies to articles in the form of ported containers of substances pourable or otherwise dispensable from the containers.

In attaining this and other objects, applicants provide, in one aspect, an EAS marker assembly comprising a housing defining an interior cavity and an EAS marker disposed in the housing interior cavity, the housing having an exterior flexible member cantilever-supported by the housing.

In another aspect, applicants provide, in combination, a container having an inlet/outlet port and an EAS marker assembly configured to be passable through the inlet/outlet port into an interior of the container and thereupon to expand to a dimension exceeding a dimension of the container inlet/outlet port.

The invention will be further understood from consideration of the following description of preferred embodiments thereof and from the drawings where like reference numerals identify like parts throughout.

DETAILED DESCRIPTION OF PREFERRED EMBODIMENTS

Figure 2:
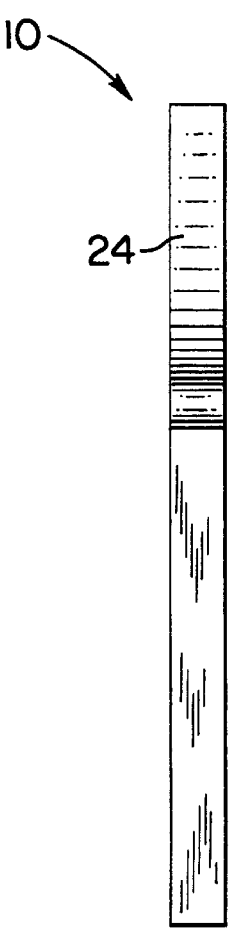
FIG. 2 is a right side elevation of the FIG. 1 housing part.
Figure 1:
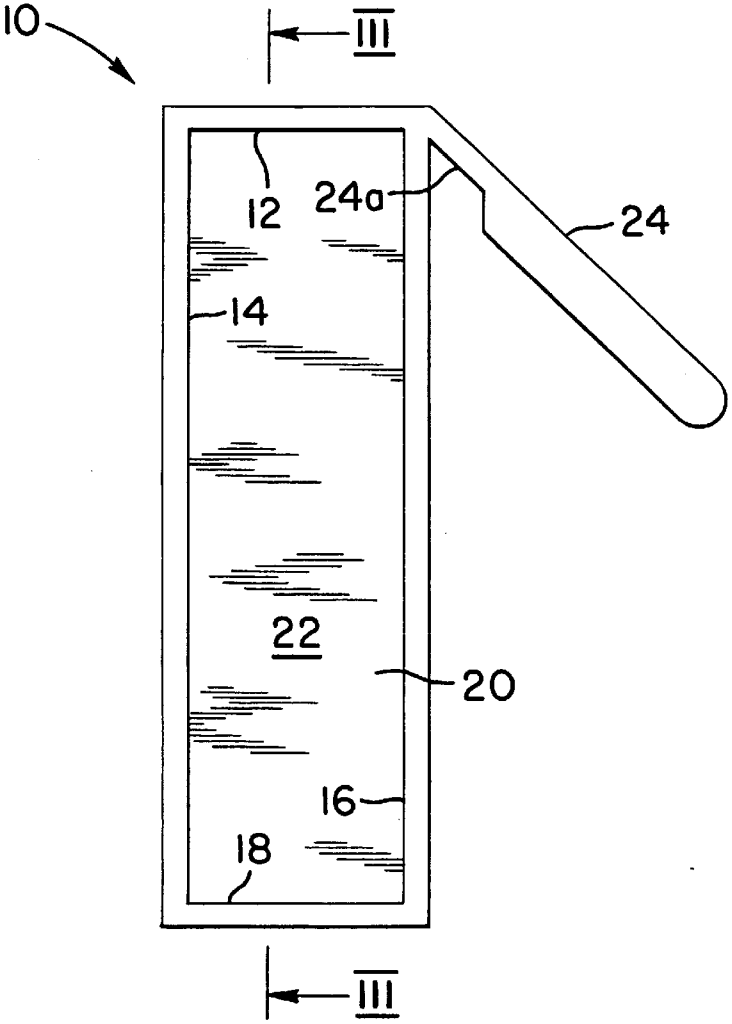
FIG. 1 is a front elevation of a housing part of an EAS marker assembly in accordance with the invention.
Figure 3:
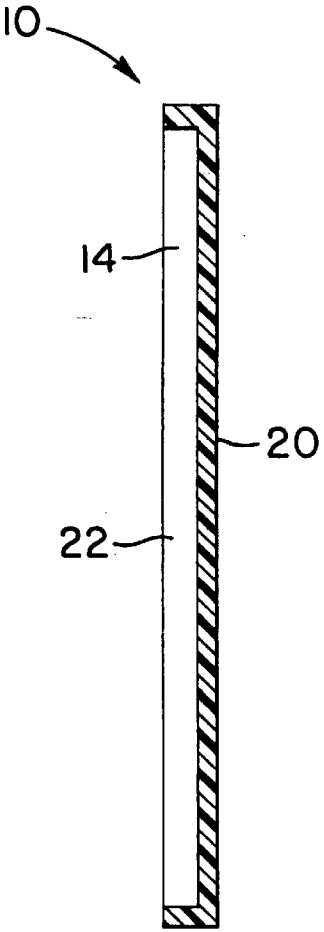
FIG. 3 is a sectional view as would be seen from plane III—III of FIG. 1.

Referring to FIGS. 1–3, first housing part 10 is a molded plastic body formed with interior sidewalls 12, 14, 16 and 18 and floor 20 jointly defining cavity 22. Housing part 10 has exterior flexible member 24 cantilever-supported by the housing part.

Flexible member 24 is formed integrally with housing part 10 and includes a thinned section 24*a* in the vicinity of sidewall 12 for permitting the flexible member to pivot relative to the housing part 10, i.e., the flexible member is cantilever-supported by the first housing part.

Figure 4:
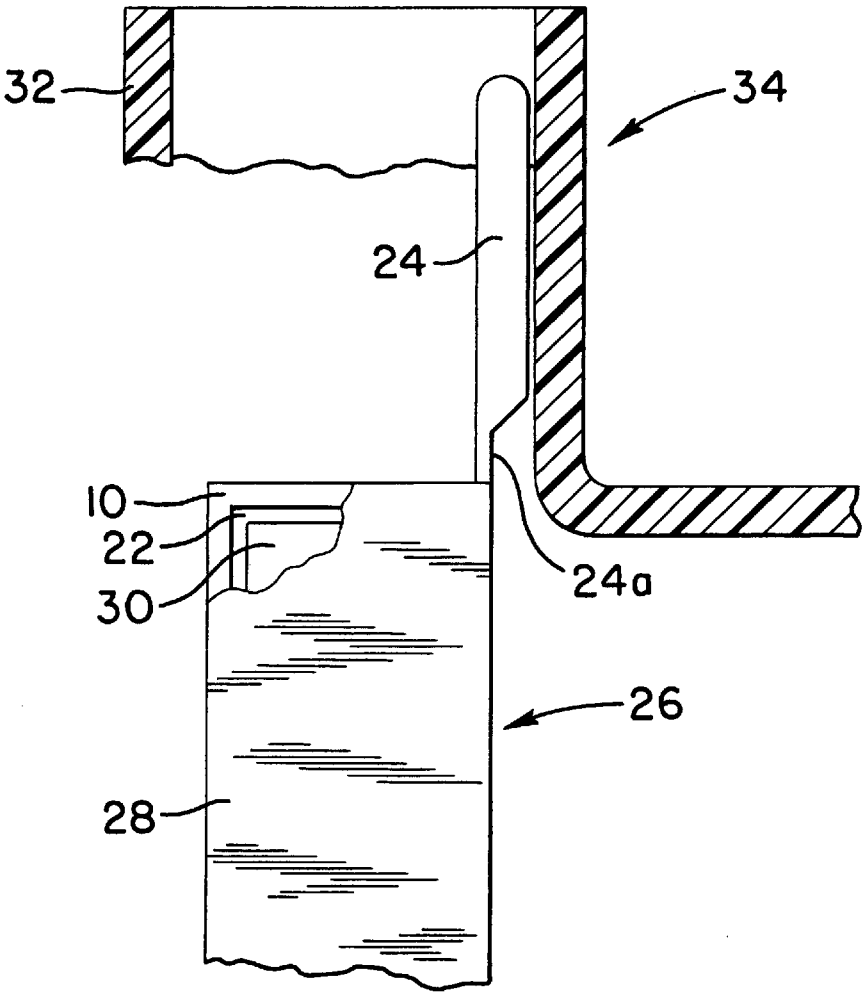
FIG. 4 is a partial view of a vessel, shown in section, and an EAS marker assembly in accordance with the invention in the course of insertion thereof into the vessel, layers of the assembly being broken away to show interior details.

Turning to FIG. 4, EAS marker assembly 26 includes first housing part 10, second housing part 28 and EAS strip member 30. Second housing part 28 is a cover which is ultrasonically sealed to first housing part 10 after insertion of EAS strip member 30 into cavity 22.

EAS marker assembly 26 is shown partly within the neck 32 of container 34. The marker assembly width is selected to permit the marker assembly to be inserted into neck. As is illustrated in the transitional insertion depicted in FIG. 4, flexible member 24 is pivoted about housing first part 10 to become generally aligned with first housing part 10 in the course of insertion by engagement of the flexible member with neck 32.

Flexible member 24 is spring biased to its FIG. 1 disposition, i.e., at approximately a forty-five degree angle to first housing part 10. Accordingly, as flexible member 24 clears neck 32, i.e., enters the interior of container 34, flexible member returns to its spring-biased disposition of FIG. 1. EAS marker assembly 26 thus becomes entrapped within container 34.

EAS marker assembly 26 will be seen to be configured to be passable through the inlet/outlet port into an interior of the container and thereupon to expand to a dimension exceeding a dimension of the container inlet/outlet port.

Figure 5:
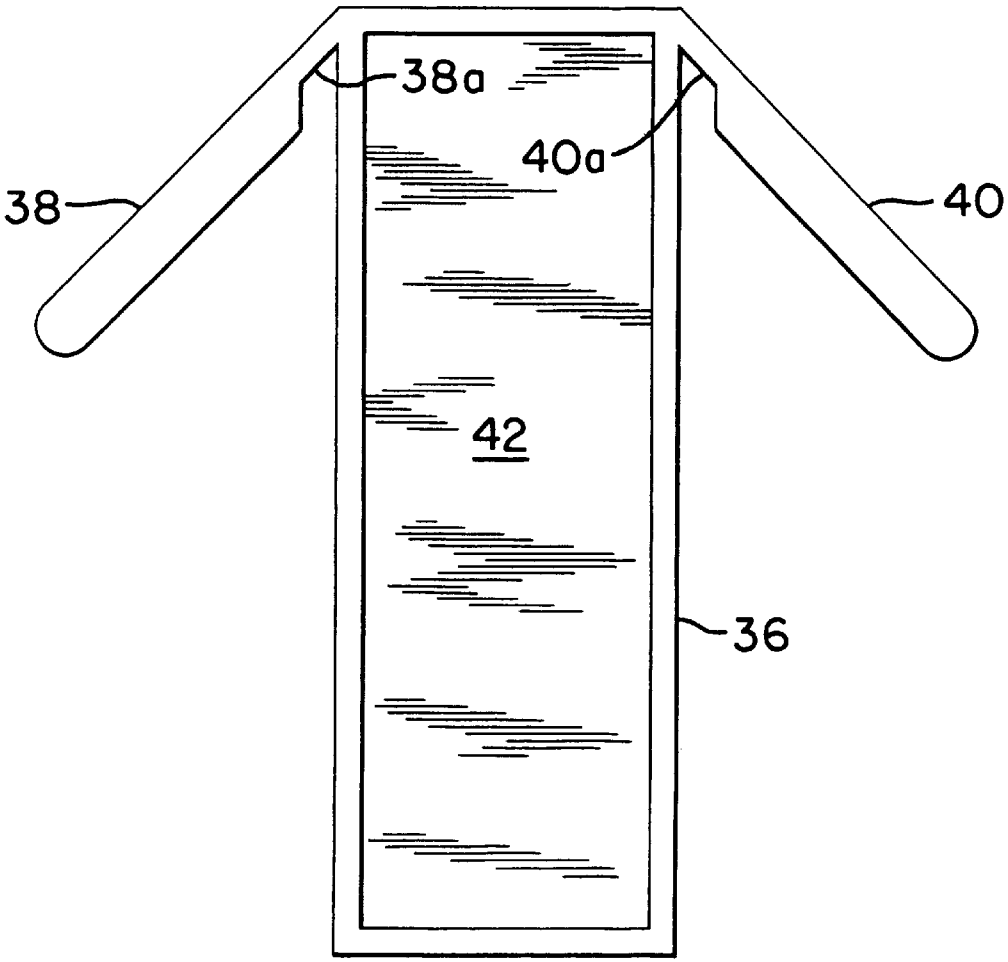
FIG. 5 is a front elevation of a housing part of a second embodiment of an EAS marker assembly in accordance with the invention.

Turning to FIG. 5, first housing part 36 of a second embodiment of the invention includes two flexible members 38 and 40, each cantilever-supported by first housing part 36 by hinges 38*a* and 40*a* and defines cavity 42 for receipt of an EAS strip member.

Figure 6:
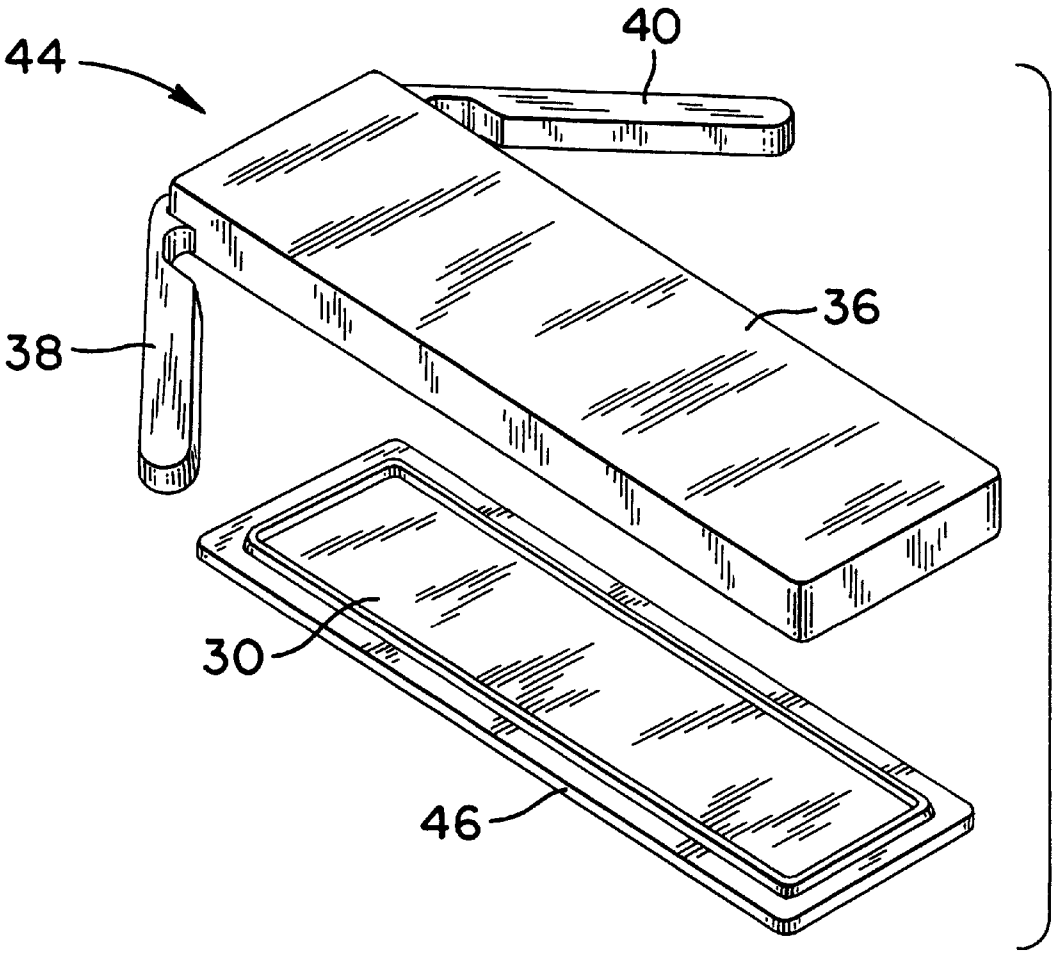
FIG. 6 is a perspective, exploded of an EAS marker housing in accordance with the invention.

As is seen in FIG. 6, EAS marker housing 44 includes first housing part 36 and second housing part 46 which has EAS strip member 30 adhesively secured thereon to enter and reside in cavity 42 of FIG. 5.

Figure 7:
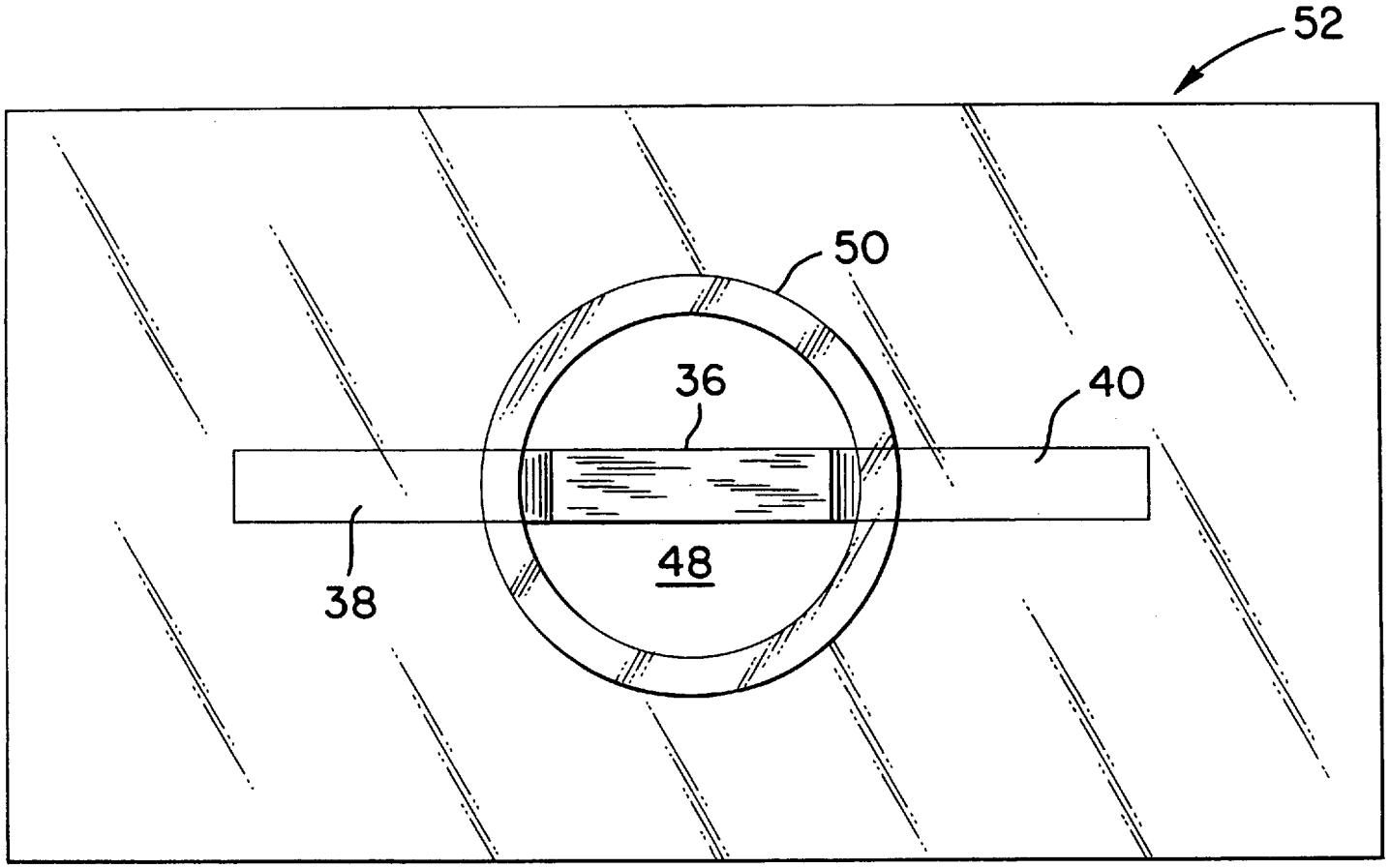
FIG. 7 is a plan view of a container with the FIG. 6 EAS marker inserted therein.

Turning to FIG. 7, the EAS assembly of FIGS. 5 and 6 is shown after having been inserted through port 48 of neck 50 of transparent container 52. As is seen the width dimension of the assembly between the ends of flexible members 38 and 40 in their spring-biased disposition far exceeds the diameter of port 48.

By way of summary of the invention and introduction to the ensuing claims, the invention will be seen to provide an EAS marker assembly comprising a housing defining an interior cavity and an EAS marker disposed in the housing interior cavity, the housing having an exterior flexible member cantilever-supported by the housing. The flexible member is self-biased to extend generally at a forty-five degree with respect to the housing. The flexible member is bendable from the self-biased disposition thereof to be alignable with a wall of the housing. The assembly housing is comprised of first and second housing parts, the first housing part defining the interior cavity. The flexible member is supported by the first housing part and is integrally formed therewith to comprise a one-piece body. The first and second housing parts are peripherally secured to one another.

Further, the invention will be seen to provide an EAS marker assembly comprising a housing defining an interior cavity and an EAS marker disposed in the housing interior cavity, the housing having first and second exterior flexible members cantilever supported by the housing.

Still further, the invention will be seen to provide, in combination, a container having an inlet/outlet port and an EAS marker assembly configured to be passable through the inlet/outlet port into an interior of the container and thereupon to expand to a dimension exceeding a dimension of the container inlet/outlet port. The EAS marker assembly comprises a housing defining an interior cavity and an EAS marker disposed in the housing interior cavity.

Various changes may be introduced in the disclosed preferred embodiments without departing from the invention. For example, while the flexible members are two in number in the second embodiment and extend from sides of the marker assembly, a further pair of flexible members may be cantilever-supported on the front and rear of the marker assembly to provide for enhanced retention of the marker assembly in a container. Further, while the flexible members in the second embodiment are integral with the first housing, one flexible member may be integral with the first housing and the other flexible member may be integral with the second housing. Accordingly, it is to be appreciated that the true spirit and scope of the invention is set forth in the following claims.

What is claimed is:

1. An EAS marker assembly comprising:

(a) a housing defining an interior cavity; and (b) an EAS marker disposed in said housing interior cavity, said housing having an exterior flexible member cantilever-supported by said housing.

2. The assembly claimed in claim 1, wherein said flexible member is self-biased to extend generally at a forty-five degree angle with respect to said housing.

3. The assembly claimed in claim 2, wherein said flexible member is bendable from the forty-five degree angle disposition thereof to be alignable with a wall of said housing.

4. The assembly claimed in claim 1, wherein said housing is comprised of first and second housing parts, said first housing part defining said interior cavity.

5. The assembly claimed in claim 4, wherein said flexible member is supported by said first housing part.

6. The assembly claimed in claim 5, wherein said flexible member and said first housing part comprise an integral, one-piece body.

7. The assembly claimed in claim 4 wherein said first and second housing parts are peripherally secured to one another.

8. An EAS marker assembly comprising:

(a) a housing defining an interior cavity; and (b) an EAS marker disposed in said housing interior cavity, said housing having first and second exterior flexible members cantilever-supported by said housing.

9. The assembly claimed in claim 8, wherein each of said flexible members is self-biased to extend generally at a forty-five degree angle with respect to said housing.

10. The assembly claimed in claim 9, wherein said flexible members are bendable from the forty-five degree angle disposition thereof to be alignable with walls of said housing.

11. The assembly claimed in claim 8, wherein said housing is comprised of first and second housing parts, said first housing part defining said interior cavity.

12. The assembly claimed in claim 11, wherein said flexible members are supported by said first housing part.

13. The assembly claimed in claim 12, wherein said flexible members and said first housing part comprise an integral, one-piece body.

14. The assembly claimed in claim 11 wherein said first and second housing parts are peripherally secured to one another.

15. In combination:

(a) a container having an inlet/outlet port; and (b) an EAS marker assembly configured to be passable through the inlet/outlet port into an interior of the container and thereupon to expand to a dimension exceeding a dimension of the container inlet/outlet port.

16. The invention claimed in claim 15, wherein said EAS marker assembly comprises a housing defining an interior cavity; and an EAS marker disposed in said housing interior cavity.

17. The invention claimed in claim 16, wherein said housing has an exterior flexible member cantilever-supported by said housing.

18. The invention claimed in claim 17, wherein said flexible member is self-biased to extend generally at a forty-five degree angle with respect to said housing.

19. The invention claimed in claim 18, wherein said flexible member is bendable from the forty-five degree angle disposition thereof to be alignable with a wall of said housing.

20. The invention claimed in claim 16, wherein said housing is comprised of first and second housing parts, said first housing part defining said interior cavity.

21. The invention claimed in claim 20, wherein said flexible member is supported by said first housing part.

22. The invention claimed in claim 21, wherein said flexible member and said first housing part comprise an integral, one-piece body.

23. The invention claimed in claim 20 wherein said first and second housing parts are peripherally secured to one another.

* * * * *